US006652421B1

(12) United States Patent
Chen

(10) Patent No.: US 6,652,421 B1
(45) Date of Patent: Nov. 25, 2003

(54) PHYSICAL WORKOUT BALL

(76) Inventor: Tao-Ming Chen, P.O. Box 82-144, Taipei (TW)

( * ) Notice: Subject to any disclaimer, the term of this patent is extended or adjusted under 35 U.S.C. 154(b) by 0 days.

(21) Appl. No.: 10/338,651

(22) Filed: Jan. 9, 2003

(51) Int. Cl.[7] ..... A63B 23/16
(52) U.S. Cl. ..... 482/49
(58) Field of Search ..... 482/48, 49, 148, 482/121, 105; 446/46; 573/588; 601/40; D21/682; 473/213, 503, 369, 393, 423

(56) References Cited

U.S. PATENT DOCUMENTS 3,542,363 A * 11/1970 Bishop
3,734,493 A * 5/1973 Hasekian
5,056,504 A * 10/1991 Mann
5,242,348 A * 9/1993 Bates ..... 482/93
6,190,292 B1 * 2/2001 Panes ..... 482/93

* cited by examiner

*Primary Examiner*—Jerome W. Donnelly
(74) *Attorney, Agent, or Firm*—Leong C. Lei

(57) ABSTRACT

A physical workout ball includes a ball and a straps; the ball is in hollow sphere shape made of rubber, plastic and other soft materials with a through hole in center, an injecting hole located on the surface of the ball to inject air or iron sand in; the straps is in a strip shape made of cloth with Velcro on both ends, the straps passes through the through hole of the ball, both ends pass through both sides of a protective pad and fasten with the Velcro. The present invention can also offer different workout and exercise methods for different body muscle.

2 Claims, 5 Drawing Sheets

PHYSICAL WORKOUT BALL

BACKGROUND OF THE INVENTION

I. Field of the Invention

This invention relates generally to a physical workout equipment and, more specifically, to a physical workout ball that can have different weight in one body and is very safe to users, even if drop on floor or hit human body will not damage floor or hurt human body, the physical workout ball can also offer different workout and exercise methods for different body muscle.

II. Description of the Prior Art

Heretofore, it is known that a dumbbell is one of the simple, effective and good physical workout equipment, many users apply it as a workout, exercise tool; however a dumbbell has following disadvantages to be improved:

1. The dumbbell mentioned above is made from a mold, however dumbbells have many different weight and have to be made from different molds, manufacturers have to prepare many different molds and manufacture them by different types, the manufacturing cost is high and manufacturing process is very tedious.
2. The dumbbell mentioned above is made from a mold to form a solid heavy metal body, when users move or swing them, the dumbbell might drop to damage the floor, hit other objects or even hurt users' feet causes wound and bone fracture.
3. The major purpose of the dumbbell is to hold and swing by hands to workout the arm muscle without other application.

SUMMARY OF THE INVENTION

It is therefore a primary object of the invention to provide a physical workout ball that can offer different weight and safety to apply, even if drop on floor or hit human body will not cause damage to floor or human body.

It is still an objective of this invention to provide a physical workout ball in which users can have different workout methods for different body muscle.

In order to achieve the objective set forth, a physical workout ball in accordance with the present invention comprises a ball in hollow sphere shape made of rubber, plastic and other soft materials with a through hole in center, an injecting hole located on the surface of the ball to inject air or iron sand in; a straps in a strip shape made of cloth with Velcro on both ends, the straps passes through the through hole of the ball, both ends pass through both sides of a protective pad and fasten with the Velcro.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
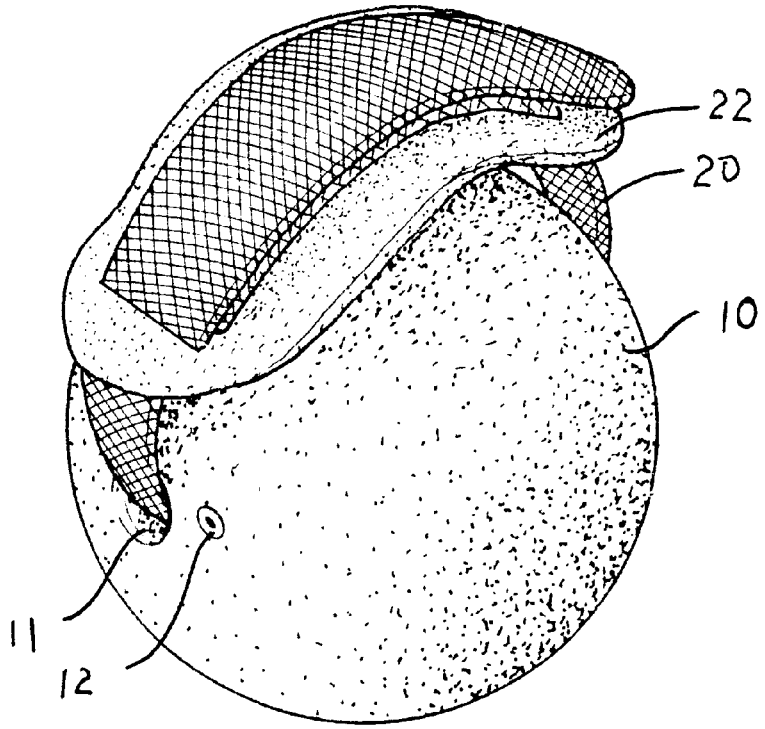
FIG. 1 is a perspective view of the present invention.

Referring to FIG. 1, the present invention is composed of a ball (10) and a strap (20). The functions of each component are described below: The ball (10), (as shown in FIG. 2 and FIG. 3), is in hollow sphere shape made of rubber, plastic and other soft materials with a through hole (11) in center, an injecting hole (12) is on the surface of the ball (10) to pour air or iron sand (13) in.

Figure 2:
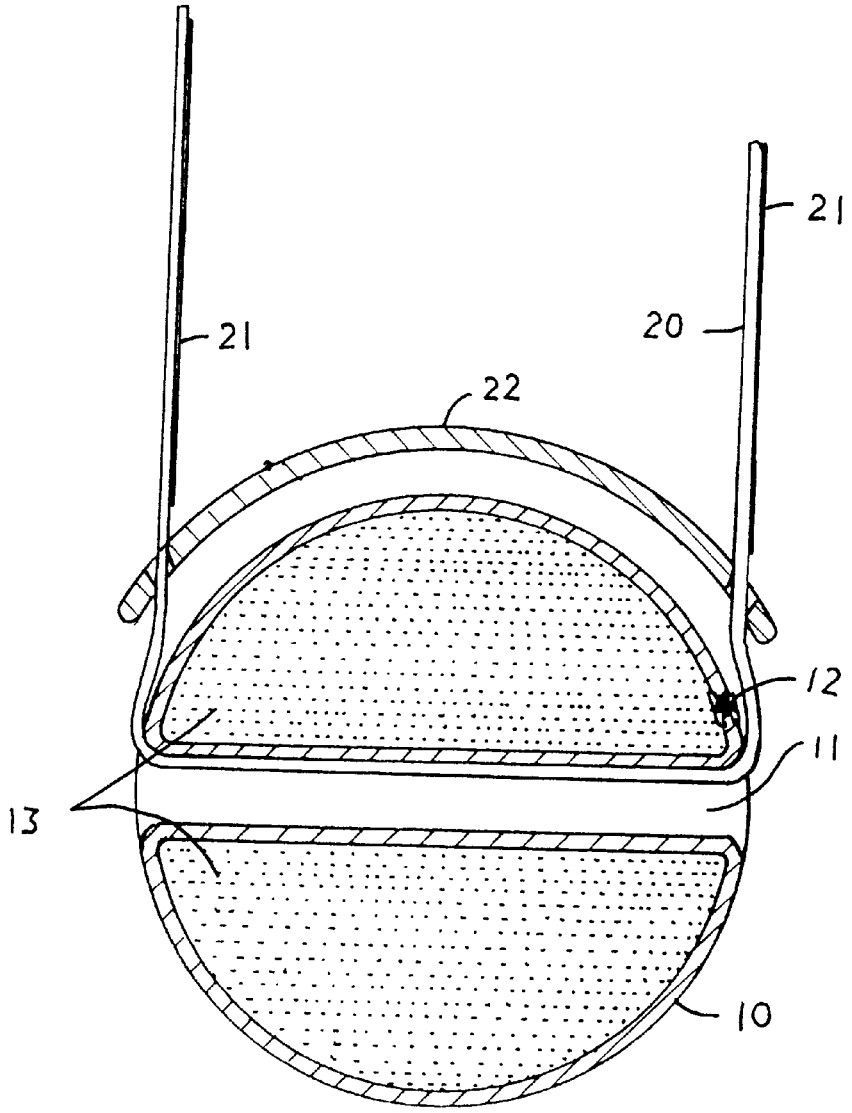
FIG. 2 is a cross-sectional view of the present invention.
Figure 3:
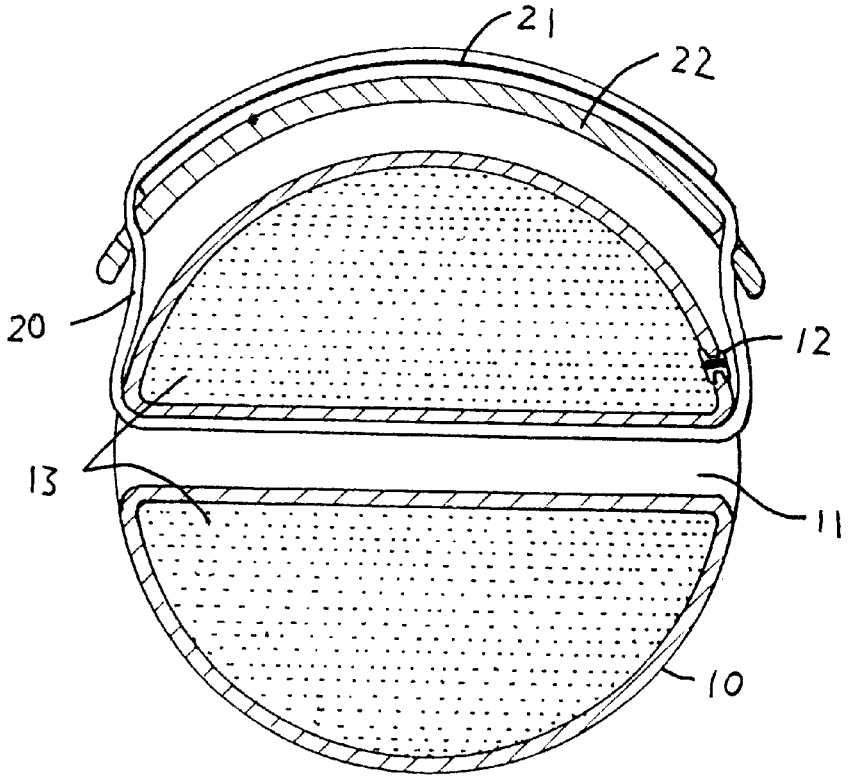
FIG. 3 is another cross-sectional view of the present invention.

The straps (20), (as shown in FIG. 2 and FIG. 3), is in a strip shape made of cloth with Velcro (21) on both ends; the straps (20) passes through the through hole (11) of the ball (10), both ends pass through both sides of a protective pad (22) and fasten with the Velcro (21).

Figure 4:
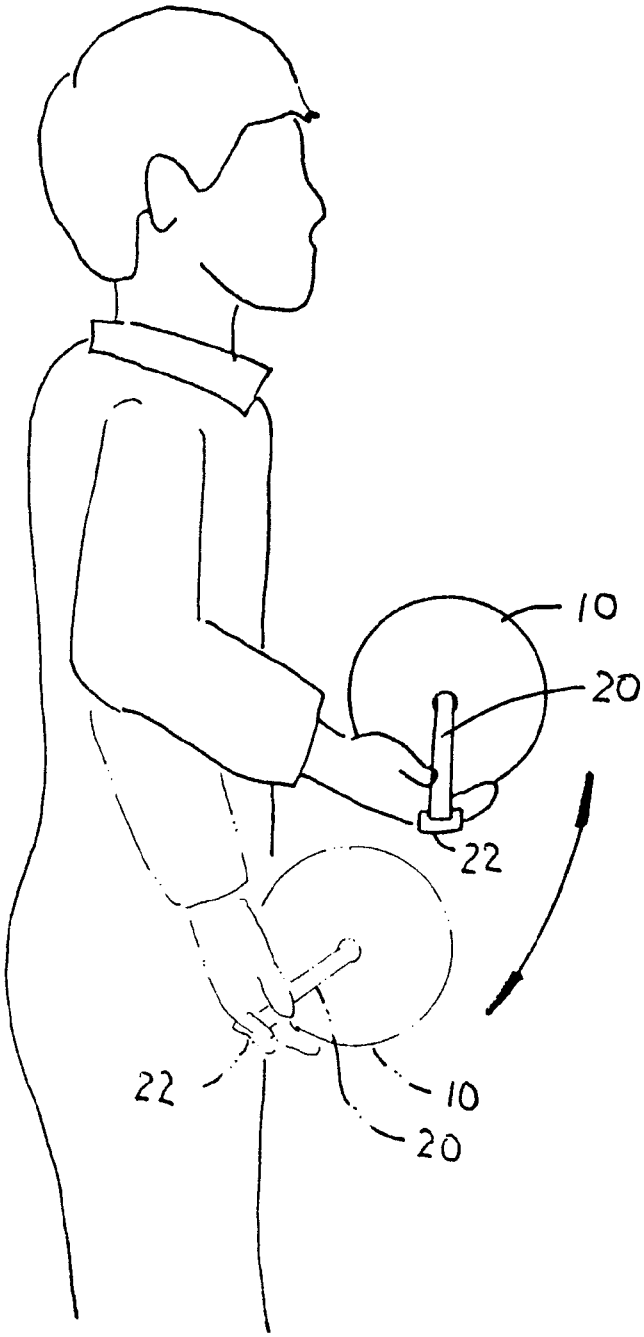
FIG. 4 is an application view of the present invention.
Figure 5:
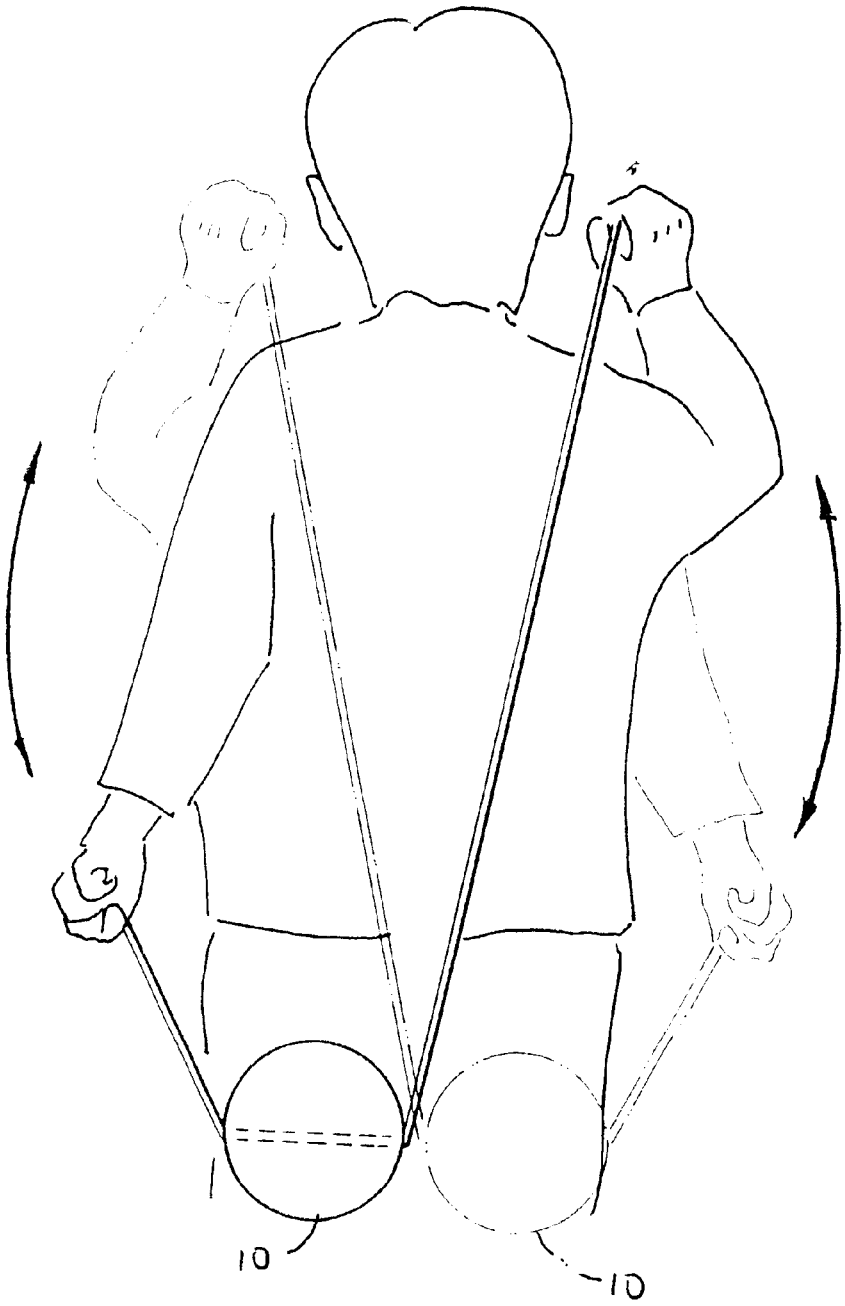
FIG. 5 is another application view the present invention.

Based on the structure described above, users can inject proper amount of air, mineral iron sand (13) from the injecting hole (12) into the ball (10) to make the ball (10) with desired weight and pressure; users can inject different amount of iron sand (13) to make the ball (10) have different weight grade, the configuration and specification of the ball (10) remains the same; such scheme can ease the manufacturing processes and lower the tooling cost. The ball (10) is made of rubber, plastic and other soft materials with air injected internally, therefore even if the heavy weight ball (10) hits people or other objects, the damage is very low; the ball (10) is very safe while moving or during exercise. Users can adjust the Velcro (21) of the straps (20) for proper tightness to hold the ball (10) with the palm, the back of hands lean against the protective pad (22) of the straps (20) to lift and swing the ball (10) to achieve the workout effect (as shown in FIG. 4). There are many other different ways to apply the ball (10), users can have a band passing through the through hole (11) of the ball (10) and placing the ball (10) on the back, pull the band with both hands and move up and down to workout the back muscle with the weight of the ball (10) (as shown in FIG. 5).

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

What is claimed is:

1. A physical workout ball comprising:

a ball in hollow sphere shape made of material with a through hole in the center, an injecting hole located on the surface of said ball to inject air or iron sand in;

a strap in a strip shape made of cloth with Velcro on both ends, said straps passing through said through hole of said ball, both ends pass through sides of a protective pad and fasten with said Velcro.

2. The physical workout ball recited in claim 1, wherein a band passes through said through hole of said ball.

* * * * *